US010371465B2

(12) United States Patent
Richter et al.

(10) Patent No.: US 10,371,465 B2
(45) Date of Patent: Aug. 6, 2019

(54) HEAT EXCHANGER

(71) Applicant: Mahle International GmbH, Stuttgart (DE)

(72) Inventors: Jens Richter, Grossbottwar (DE); Bjoern Haller, Sindelfingen (DE); Johannes Kaelber, Muehlacker (DE); Thomas Merten, Knittlingen (DE); Tobias Isermeyer, Lowenstein (DE)

(73) Assignee: Mahle International GmbH (DE)

( * ) Notice: Subject to any disclaimer, the term of this patent is extended or adjusted under 35 U.S.C. 154(b) by 55 days.

(21) Appl. No.: 14/970,115

(22) Filed: Dec. 15, 2015

(65) Prior Publication Data

US 2016/0169599 A1 Jun. 16, 2016

(30) Foreign Application Priority Data

Dec. 16, 2014 (DE) ..... 10 2014 226 090

(51) Int. Cl.
*F28F 13/12* (2006.01)
*F28F 9/22* (2006.01)
(Continued)

(52) U.S. Cl.
CPC ..... *F28F 13/12* (2013.01); *F28D 7/16* (2013.01); *F28F 1/128* (2013.01); *F28F 9/22* (2013.01)

(58) Field of Classification Search
CPC ..... F28F 13/12; F28F 9/22; F28F 2009/226; F28D 2021/0082; F28D 7/16; F28D 7/1607; F28D 7/1623; F28D 7/163; F28D 7/1638
See application file for complete search history.

(56) References Cited

U.S. PATENT DOCUMENTS 4,623,019 A * 11/1986 Wiard ..... F28D 9/0068 165/135
7,182,125 B2 * 2/2007 Martin ..... F28F 13/12 165/109.1
(Continued)

FOREIGN PATENT DOCUMENTS

EP 1707911 A1 10/2006
JP 2000111294 A 4/2000
WO WO-2009120128 A1 10/2009

OTHER PUBLICATIONS

English abstract for EP-1707911.
English abstract for JP-2000111294.
German Search Report for DE-102014226090.6, dated Oct. 7, 2015.

*Primary Examiner* — Christopher R Zerphey
*Assistant Examiner* — Harry E Arant
(74) *Attorney, Agent, or Firm* — Fishman Stewart PLLC

(57) ABSTRACT

A heat exchanger may include input-side and output-side tube plates and tubes supported therein, forming a first flow duct for a first medium. A housing may surround the tube plates and the tubes, forming a second flow duct for a second medium running between the tubes in the housing. The heat exchanger may further include at least one turbulence-generating insert arranged in the second flow duct between the tubes, the insert having ducts with permeable side walls for the second medium, and at least one dividing wall duct having closed side walls and being spaced apart at least at one longitudinal end from the housing. The at least one dividing wall duct may be designed to be open at both longitudinal ends, may be produced by a compression process, and may have a rising first flank and a second flank engaging below the second flank.

19 Claims, 5 Drawing Sheets

(51) Int. Cl.
*F28D 7/16* (2006.01)
*F28F 1/12* (2006.01)

(56) References Cited

U.S. PATENT DOCUMENTS 8,418,752 B2 * 4/2013 Otahal ..... B21D 53/02 165/109.1
2005/0161206 A1 * 7/2005 Ambros ..... F02B 29/0462 165/173
2011/0023518 A1 * 2/2011 Amaya ..... F28D 7/0041 62/304

* cited by examiner

HEAT EXCHANGER

CROSS-REFERENCE TO RELATED APPLICATIONS

This application claims priority to German Patent Application No. 10 2014 226 090.6, filed Dec. 16, 2014, the contents of which are hereby incorporated by reference in their entirety.

TECHNICAL FIELD

The present invention relates to a heat exchanger for a motor vehicle with tubes which are trapped at the respective longitudinal end sides in an input-side and an output-side tube plate. The invention also relates to a turbulence-generating insert for a heat exchanger of this type.

BACKGROUND

WO 2009/120128 A1 discloses a heat exchanger of the type in question with tubes which are trapped at the respective longitudinal end sides in an input-side and an output-side tube plate, wherein the tubes form a first flow duct for a first medium, for example exhaust gas, and with a housing which surrounds the tube plates and tubes and has an inlet and an outlet. In the housing, a second flow duct for a second medium, for example for coolant, runs between the tubes. The first and the second medium flow here through the heat exchanger in a counterflow. In addition, turbulence-generating inserts which form ducts, which run substantially transversely with respect to the flow direction of the second medium and have permeable side walls for the second medium, and are intended to improve a transfer of heat between the second medium and the tubes, are arranged in the second flow duct between the tubes. At least one dividing wall duct having closed side walls is provided here per turbulence-generating insert. Said dividing wall duct is intended to force a predefined flow in the second flow duct in order thereby to be able to avoid in particular the risk of "dead regions", in which a sufficient transfer of heat does not take place and, for example, boiling of a coolant could be a cause of concern.

EP 1 707 911 B1 discloses a further heat exchanger in the manner of a charge-air cooler for a motor vehicle, said heat exchanger consisting of a multiplicity of flat tubes which open into header boxes and through which a gaseous medium, for example exhaust gas, flows. A flow path for a coolant runs here between the flat tubes, said flow path being bounded by a housing, which surrounds the flat tubes and has a corresponding inlet and outlet for the coolant. The housing is composed here of two side parts and two covers, wherein the side parts are brazed to a block consisting of flat tubes, tube plates and flow paths. The inlets and outlets for the coolant are located on the covers. The covers are furthermore welded to the side parts and to the tube plates, whereas the header boxes are mechanically connected to the tube plates. By this means, it is intended to be possible to produce the heat exchanger cost-effectively.

SUMMARY

Of course, as the thermal load (temperature and charge-air throughput) increases, the density of the heat flow rate in a bottom region of a tube-bundle charge-air cooler also increases. The design in this case causes a comparatively poor throughflow of coolant in the vicinity of the bottom, as a result of which, under unfavourable circumstances, boiling effects may occur in said regions. However, such a boiling of the coolant should absolutely be avoided. Therefore, the present invention is concerned with the problem of specifying, for a heat exchanger of the type in question, an improved or at least an alternative embodiment which, in particular, reduces a risk of a coolant boiling.

This problem is solved according to the invention by the subject matter of the independent claims. Advantageous embodiments are the subject matter of the dependent claims.

The present invention is based on the general concept of integrating a dividing wall duct into a turbulence-generating insert of a heat exchanger which is known per se, wherein said dividing wall duct is designed, according to the invention, to be open at both longitudinal ends and, as a result, the flow can pass therethrough. The dividing wall duct here is produced by a compression process and has a rising first flank and a second flank engaging below the latter. The broken undulating shape permits in particular simplified production of the dividing wall duct by compressing the turbulence-generating insert in the plane of same. The dividing wall duct makes it possible to force a significantly improved flow of coolant, in particular in a bottom region at risk of boiling, as a result of which the boiling risk prevailing there can be considerably reduced. At the same time, the boiling risk in the region of the dividing wall duct can also be significantly lowered since an improved heat exchange and therefore also an improved removal of heat can be forced by the coolant flowing in the dividing wall duct. By means of the dividing wall duct through which, according to the invention, the flow can pass, a pressure loss within the heat exchanger can also be reduced since the coolant no longer backs up in the dividing wall duct, but rather likewise flows. By means of the dividing wall duct designed according to the invention, coolant can better flow in particular through a bottom region of the input-side tube plate and the risk of boiling occurring can be reduced there.

In an advantageous development of the solution according to the invention, the at least one turbulence-generating insert is designed as a sheet-metal punched part. The production of the turbulence-generating insert as a sheet-metal punched part can permit particularly economic and cost-effective manufacturing, wherein the dividing wall duct can be formed, for example, by a corresponding wave. The turbulence-generating insert is first of all rolled here and the dividing wall punched therein in a second manufacturing step. Customarily, all of the turbulence-generating inserts arranged in the housing are designed here as identical parts, which reduces the multiplicity of parts and lowers the production costs further.

According to an advantageous development of the invention, the dividing wall duct has a cross section A of 1.0 $mm^2 \leq A \leq 1.5\ mm^2$, in particular a cross section of $A=1.2\ mm^2$. Additionally or alternatively, the dividing wall duct can have a hydraulic diameter $d_h$ of $0.30\ mm \leq d_h \leq 0.40\ mm$, in particular a hydraulic diameter of $d_h=0.361$ mm. By defining the cross section available for the throughflow and the hydraulic diameter, it is possible to influence the throughflow and therefore influence any dead regions or to avoid the latter.

In an advantageous development of the solution according to the invention, both the inlet and the outlet are arranged on an upper part of the housing, and the dividing wall duct runs substantially orthogonally from the upper part to a lower part of the housing. However, in this case, the dividing wall duct is shorter than the entire height between lower part and upper part of the housing and therefore permits coolant to pass through in accelerated form in respect of the flow in the region not closed by the dividing wall duct. The dividing wall duct is customarily at a distance h from a lower edge of the turbulence-generating insert and therefore also from a lower part of the housing, and at a distance h1 from an upper edge of the turbulence-generating insert, and thereby forces an improved flow of coolant in a region of the heat exchanger which is particularly at risk and is in the vicinity of the bottom, wherein at the same time coolant can flow through the dividing wall duct because of the two distances h, h1 from the lower part and from the upper part of the housing or from the upper and lower edge of the turbulence-generating insert, and therefore there is no longer any burning risk even in this region. Additionally or alternatively, it is also conceivable for the dividing wall duct to run as far as the upper edge of the turbulence-generating insert and for the upper part and/or the lower part of the housing to have, in the region of the dividing wall duct, a protrusion, via which, in turn, the distance h1 is defined.

It is also conceivable, purely theoretically, for the dividing wall duct to be at a distance h from the lower edge of the turbulence-generating insert and to pass through as far as the upper edge, but wherein a side wall of the dividing wall duct, which side wall faces the inlet (coolant inlet), is notched in the region of the upper edge and the flow can pass through the dividing wall duct via said notch. This non-definitive list already makes it possible to foresee which diverse possibilities for the flow through the dividing wall duct are enabled by corresponding configurations. Of sole importance here is that the dividing wall duct always ends at a distance from the lower part of the housing in order to permit a throughflow of the coolant there and an improved exchange of heat in the bottom region of the heat exchanger, and at the same time has any type of opening at the upper longitudinal end thereof in order to permit coolant to flow therethrough and therefore to avoid the coolant backing up in the dividing wall duct. This is because the backing up of the coolant in the dividing wall duct not only conceals the risk of boiling occurring locally, but in addition also increases the pressure loss.

At least one turbulence-generating insert expediently has a height of 50 mm<H<96 mm, in particular 64 mm or 80 mm, wherein the dividing wall duct is shorter by the height of 3 mm<h<20 mm then the height H of the turbulence-generating insert. A ratio between the height H of the turbulence-generating insert and the distance h of the dividing wall duct from the lower edge of the turbulence-generating insert is between 2.5 and 32, preferably around approx. 6.4. As the ratio increases, the cross section of the region permeable to coolant is reduced, as a result of which the coolant pressure loss is increased since the coolant has to be accelerated at said narrow point. This in turn gives rise to an increased speed vector directly towards the input-side tube plate.

Further important features and advantages of the invention emerge from the dependent claims, from the drawings and from the associated description of the figures with reference to the drawings.

It goes without saying that the features mentioned above and those which have yet to be explained below can be used not only in the respectively stated combination, but also in different combinations or on their own without departing from the scope of the present invention.

Preferred exemplary embodiments of the invention are illustrated in the drawings and are explained in more detail in the description below, wherein the same reference numbers refer to identical or similar or functionally identical components.

BRIEF DESCRIPTION OF THE DRAWINGS

In the drawings, in each case schematically.

DETAILED DESCRIPTION

Figure 1:
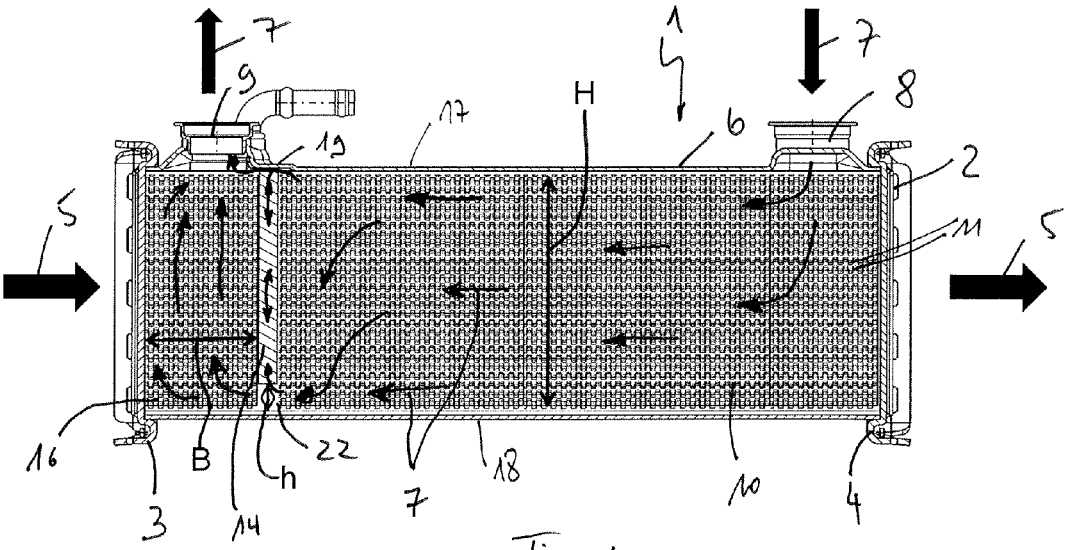
FIG. 1 shows a sectional illustration through a heat exchanger according to the invention.
Figure 10:
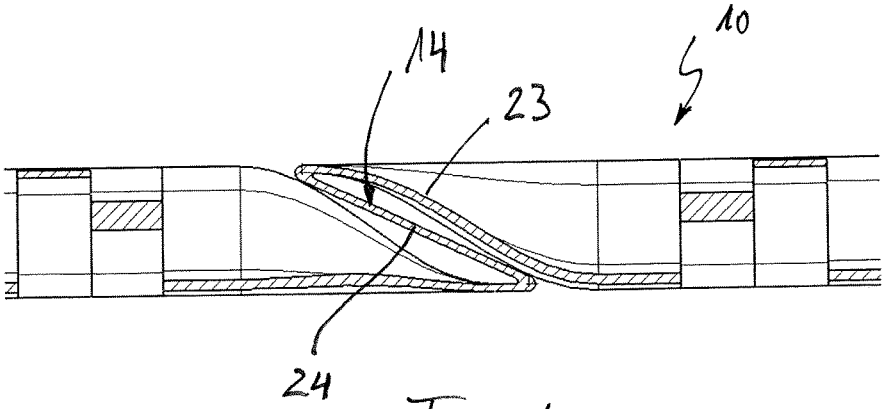
FIG. 10 shows a sectional illustration through a dividing wall duct according to the invention.
Figure 11:
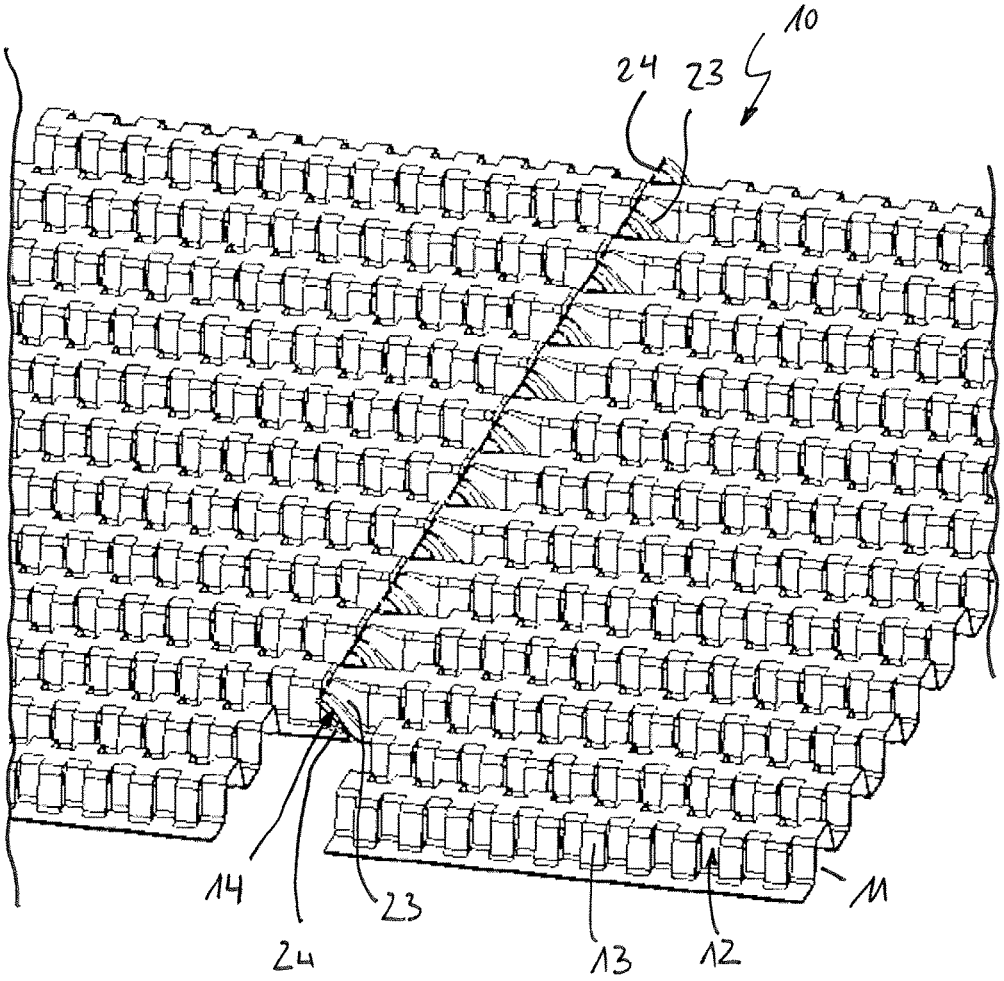
FIG. 11 shows a turbulence-generating insert with a dividing wall duct as per FIG. 10.

According to FIG. 1, a heat exchanger 1 according to the invention, which can be designed, for example, as a charge-air cooler or exhaust gas cooler, has tubes 2, in particular flat tubes, which are trapped at the longitudinal end sides in an input-side tube plate 3 and in an output-side tube plate 4. On the input side and on the output side, is set with respect to a flow direction of a first medium 5, for example charge air or exhaust gas, which flows through tubes 2. The first medium 5, for example exhaust gas, therefore flows from the left to the right through the heat exchanger 1 illustrated as per FIG. 1. The tubes 2 together with the two tube plates 3, 4 and a housing 6 surrounding the latter form a second flow duct for a second medium 7, for example coolant. An inlet 8 (coolant inlet) and an outlet 9 (coolant outlet) are arranged here on the housing 6. The first and second medium 5, 7 flow through the heat exchanger 1 in a parallel flow, in the counterflow method here. Of course, it is also conceivable here for the two media 5, 7 to flow through the heat exchanger 1 in a co-current flow. In addition, turbulence-generating inserts 10 (cf. also FIGS. 2 to 8) are arranged in the second flow duct between the individual tubes 2, said turbulence-generating inserts 10 forming ducts 11 which run substantially parallel to the flow direction of the first and second medium 5, 7 and have permeable side walls 12 for the second medium 7. Turbulence-generating elements 13 are punched here out of the side walls 12 and force the second medium 7 to swirl and, as a result, bring about an improved transmission of heat. Furthermore, at least one dividing wall duct 14 having closed side walls 15 is provided per turbulence-generating insert 10. Said dividing wall duct 14 is spaced apart from the housing 6, here from the lower part 18 or from the edge 20', at at least one longitudinal end, here at the lower longitudinal end, and thereby provides a passage 22 with the height h for the second medium 7. According to the invention, said at least one dividing wall duct 14 is now designed to be open at both longitudinal ends and, as a result, in the state installed in the housing 6, the second medium 7, i.e. coolant, can pass therethrough. The dividing wall duct 14 according to the invention, as illustrated in particular in detail in FIGS. 10 and 11, is produced by a compression process and has a rising first flank 23 and a second flank 24 engaging below the latter. By means of the dividing wall duct 14 arranged substantially transversely with respect to the flow direction of the first medium 5 and transversely with respect to the ducts 11, a deflection of the second medium flow 7 is forced to the extent that said medium flow flows particularly readily through a region 16 particularly at risk of boiling (cf. FIG. 1) and undesirable boiling of the second medium 7, that is to say of the coolant, is prevented there.

The dividing wall duct 14 is customarily at a distance of 10 mm≤B≤60 mm, preferably of 25 mm, ≤B≤45 mm, from the input-side tube plate 3. Furthermore, the dividing wall duct 14 has a cross section A of 1.0 $mm^2 \leq A \leq 1.5$ $mm^2$, in particular a cross section of A=1.2 $mm^2$, and/or a hydraulic diameter $d_h$ of 0.30 mm≤$d_h$≤0.40 mm, in particular a hydraulic diameter of $d_h$=0.361 mm. The flow through the dividing wall duct 14 can thereby be reduced. In addition, stamped formations could also reduce the flow cross section.

The turbulence-generating insert 10 can be designed here in a simple manner in terms of manufacturing and at the same time in a cost-effective manner as a sheet-metal punched part, wherein, of course, other embodiments in the form of a rolled component are also conceivable.

Looking at FIG. 1, it can be seen that both the inlet 8 and the outlet 9 are arranged on an upper part 17 of the housing 6, and the dividing wall duct 14 runs substantially orthogonally from the upper part 17 to a lower part 18 of the housing 6. The dividing wall duct 14 is arranged here, as shown in FIG. 1, in the region of the outlet 9.

Looking more precisely at FIG. 1, it can be seen that the upper part 17 has, in the region of the dividing wall duct 14, a protrusion 19 which, even in the case of a dividing wall duct 14 reaching in this region as far as the edge 20 of the turbulence-generating insert 10, makes it possible to design said dividing wall duct to be open in this region. Of course, the lower part 18 can additionally or alternatively also have such a protrusion 19. If the upper part 17 has a protrusion 19 of this type, it is possible, for example, to use a turbulence-generating insert 10 illustrated as per FIG. 2 without there having to be a concern that the dividing wall duct 14 is closed at the upper end, as would be the case in an upper part 17 without a protrusion 19 of this type.

Figure 3:
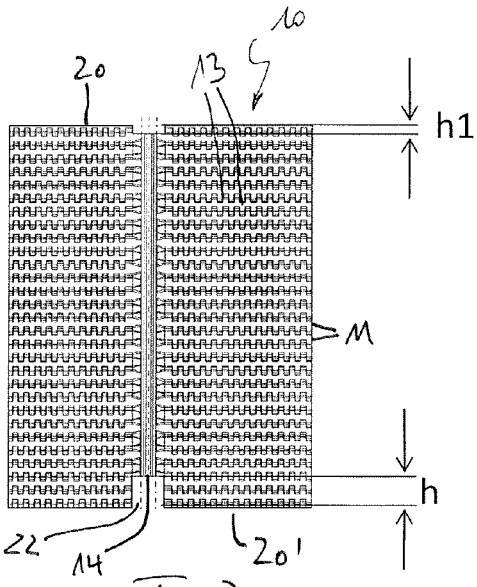
FIGS. 3, 4 show different embodiments of a turbulence-generating insert.
Figure 4:
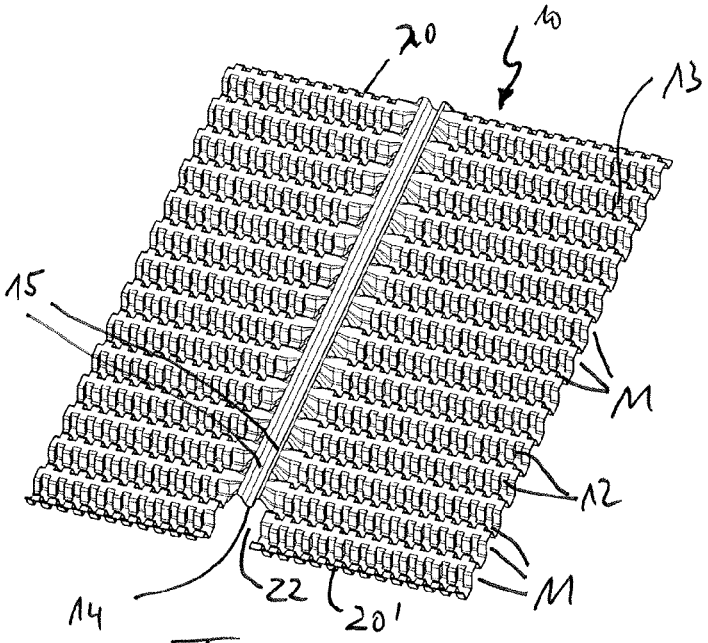

If the upper part 17 does not have such a protrusion 19, the turbulence-generating insert 10 can be designed, for example, as shown in FIG. 3, wherein, in this case, the dividing wall duct 14 is at a distance h from a lower edge 20' or from the lower part 18 and at a distance h1 from the upper edge 20 of the turbulence-generating insert 10 or from the upper part 17 of the housing 6. The actual dividing wall duct 14 is therefore shorter by the sum of the two distances h and h1 than the entire height H of the turbulence-generating insert 10.

Looking at the turbulence-generating insert 10 as per FIGS. 1 and 3, said turbulence-generating insert has a height H of between 50 and 96 mm, in particular of approx. 64 or 80 mm, wherein the dividing wall duct 14 is shorter by the distance h than the height H of the turbulence-generating insert 10. The height h, that is to say the distance from the edge 20, is between 10 and 20 mm here. A ratio between the height H and the height h, that is to say between the height H of the turbulence-generating insert 10 and the distance of the dividing wall duct 14 from the edge 20, is between 2.5 and 32, preferably approx. 6.4 or 8, here. With such a ratio, both the risk of the coolant boiling can be optimally reduced and a pressure loss within the heat exchanger 1 can still be kept within a tolerable extent.

Figure 2:
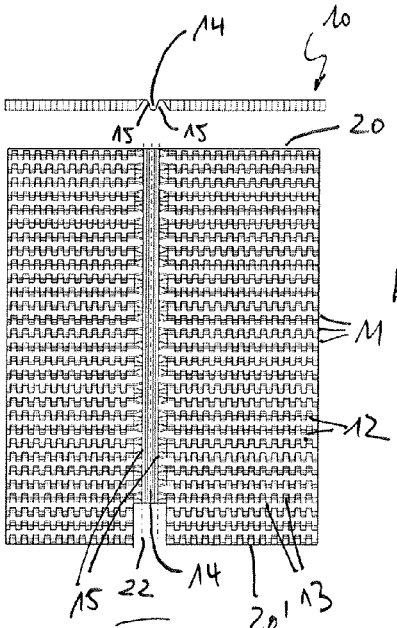
FIG. 2 shows a possible embodiment of a turbulence-generating insert for a heat exchanger according to the invention, shown as per FIG. 1, before the compression.

FIG. 4 once again illustrates the turbulence-generating insert 10 as per FIG. 2 in a perspective view.

Additionally or alternatively to the dividing wall duct 14, which is set back in the region of the upper part 17, said dividing wall duct can also be at a distance h from the lower edge 20' and is continuous to the upper part 17, that is to say as far as an edge 20 (cf. FIG. 8) of the turbulence-generating insert 10, but wherein a side wall 15*a* of the dividing wall duct 14, which side wall faces the inlet 8, is notched in the region of the upper edge 20. A flow through the dividing wall duct 14 and therefore an improved transfer of heat in this region can thereby also be achieved. In addition, a backing up of the coolant, that is to say of the second medium 7, in the dividing wall duct 14, which backing up increases the pressure loss, can be reliably avoided. The notch 21 is illustrated here on the turbulence-generating inserts 10 as per FIGS. 7 and 8.

Figure 5:
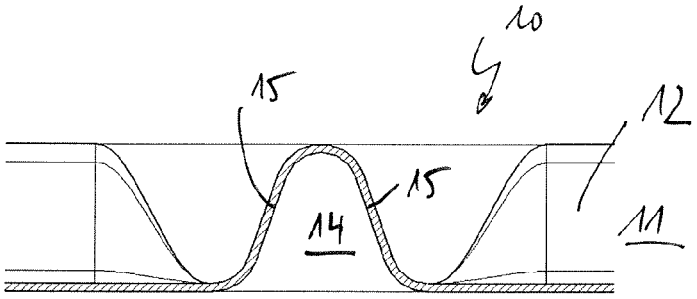
FIGS. 5, 6 show a sectional illustration through a turbulence-generating insert in the region of a dividing wall duct in different embodiments before the compression.
Figure 6:
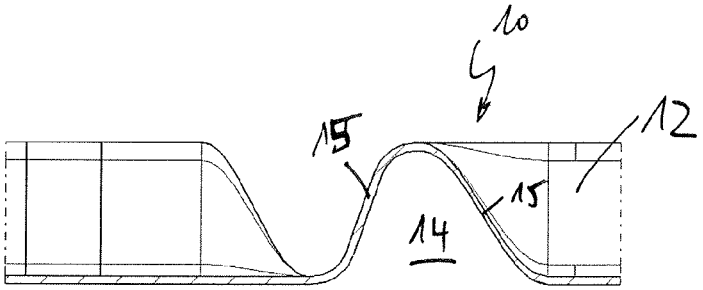
Figure 7:
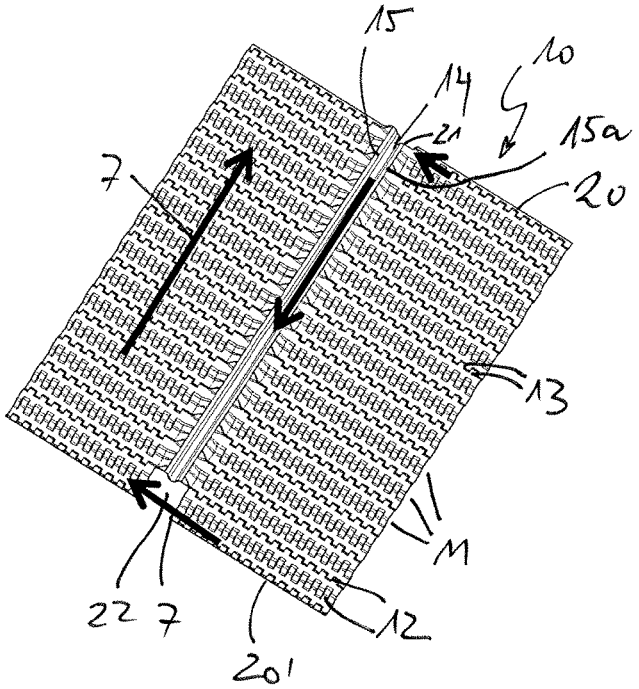
FIG. 7 shows a possible flow conduction of a coolant flow through the turbulence-generating insert in the case of a dividing wall duct with a notched side wall, likewise also before the compression.
Figure 8:
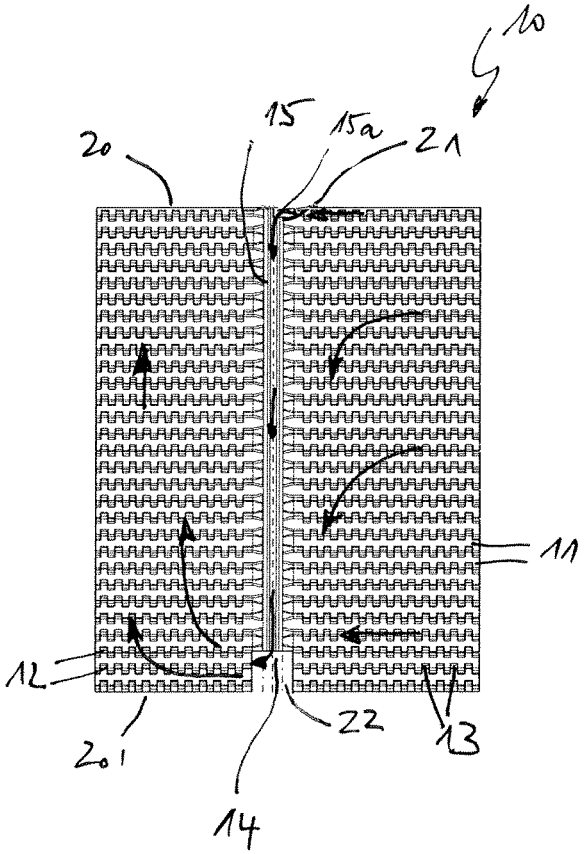
FIG. 8 shows a frontal view of the turbulence-generating insert shown as per FIG. 7.

Looking once again at FIGS. 5 and 6, different embodiments of the dividing wall duct 14 can be seen in said figures. The dividing wall duct 14 of a turbulence-generating insert 10 of this type is produced, for example, by different method steps, wherein, in a first step, first of all a wave structure is introduced in the region of the dividing wall duct 14, for example is rolled or punched, whereupon, in a second method step, the non-continuous dividing wall duct 14 is then stamped in said region and subsequently compressed. Of course, this can take place fully automatically.

Figure 9:
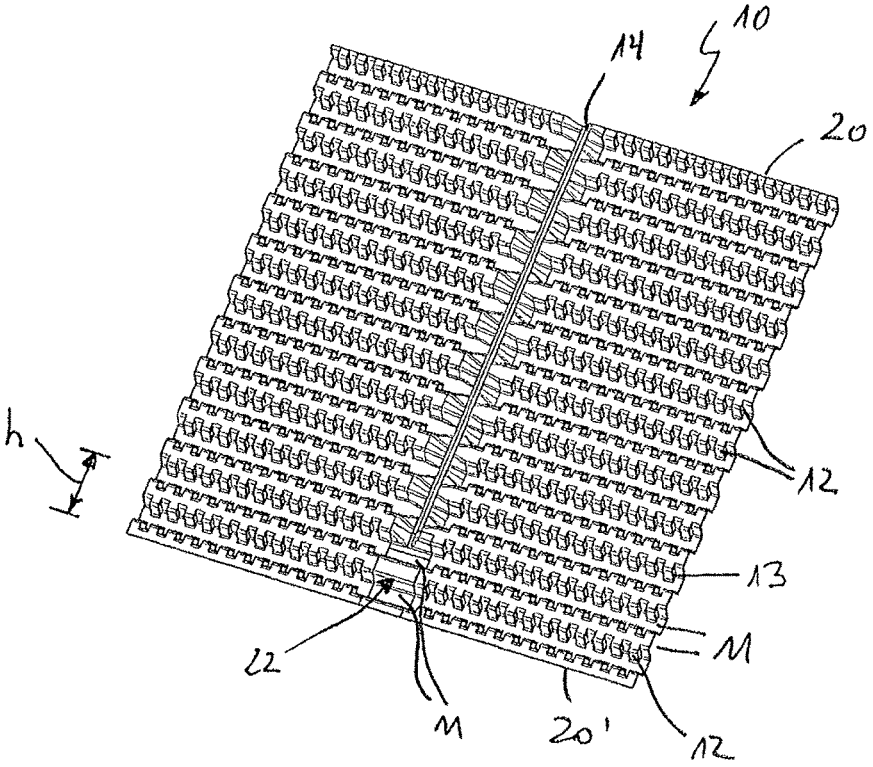
FIG. 9 shows a further possible embodiment of the turbulence-generating insert.

Looking at the turbulence-generating insert 10 as per FIG. 9, it can be seen that the dividing wall duct 14 is also at a distance h here from the lower edge 20' of the turbulence-generating insert 10 and the ducts 11 continue in the region not occupied by the dividing wall duct 14. This means that the dividing wall duct 14 does not have to be notched or punched on the longitudinal end side and nevertheless forms a passage 22 for the second medium 7. The punching is therefore omitted.

With the heat exchanger 1 according to the invention and the turbulence-generating inserts 10 according to the invention, it is possible in particular to achieve a significantly improved throughflow of coolant in an indirect charge-air cooler, of tube bundle construction, as a result of which, in particular, the risk of a boiling tendency can be considerably reduced. By avoiding boiling of the second medium 7, that is to say of the coolant, the durability of the second medium 7, in particular of the coolant, can also be improved since, in the event of boiling, inhibitors in the coolant are decomposed and, furthermore, excessive thermally induced stresses occur. In addition, by integrating the dividing wall duct 14 into the turbulence-generating insert 10, the diversity of parts can be reduced.

The invention claimed is:

1. A heat exchanger comprising:

an input-side tube plate and an output-side tube plate;

tubes supported at respective longitudinal end sides in the input-side tube plate and the output-side tube plate forming a first flow duct for a first medium;

a housing surrounding the tube plates and at least one tube forming a second flow duct for a second medium running between the tubes in the housing, the first and second mediums flowing parallel to each other, the housing having an inlet and an outlet;

at least one turbulence-generating insert arranged in the second flow duct between the tubes, the at least one turbulence-generating insert having ducts with permeable side walls for the second medium;

at least one dividing wall duct for each of the at least one turbulence-generating insert, the at least one dividing wall duct having closed side walls and being spaced apart at least at one longitudinal end from the housing;

wherein the at least one dividing wall duct is open at both longitudinal ends such that a flow can pass therethrough;

wherein the at least one dividing wall duct is produced by a compression process resulting in the at least one dividing wall duct having a rising first flank and a second flank, the rising first flank forming an obtuse angle with a portion of the bottom of the at least one turbulence-generating insert to which an end of the rising first flank is connected, the second flank forming an acute angle with another portion of the bottom of the at least one turbulence-generating insert to which an end of the second flank is connected, the rising first flank and the second flank connected to each other in a region of the top of the at least one turbulence-generating insert such that the rising first flank substantially overlaps the second flank;

wherein the at least one dividing wall duct runs transverse to the ducts in the at least one turbulence-generating insert; and wherein the ends of the rising first flank and the second flank connected to the respective portions of the bottom of the at least one turbulence-generating insert are spaced apart from one another at a distance smaller than a maximum opening distance of the dividing wall duct formed between the rising first flank and the second flank.

2. The heat exchanger according to claim 1, wherein at least one of:

the dividing wall duct has a cross sectional area A of 1.0 $mm^2 \leq A \leq 1.5\ mm^2$; and the dividing wall duct has a hydraulic diameter $d_h$ of 0.30 $mm \leq d_h \leq 0.40$ mm.

3. The heat exchanger according to claim 2, wherein the cross sectional area A is 1.2 $mm^2$.

4. The heat exchanger according to claim 2, wherein the hydraulic diameter dh is 0.361 mm.

5. The heat exchanger according to claim 2, wherein both the inlet and the outlet are arranged on an upper part of the housing, and the dividing wall duct runs substantially orthogonally from the upper part to a lower part of the housing.

6. The heat exchanger according to claim 1, wherein both the inlet and the outlet are arranged on an upper part of the housing, and the dividing wall duct runs substantially orthogonally from the upper part to a lower part of the housing.

7. The heat exchanger according to claim 6, wherein at least one of the upper part and the lower part of the housing has a protrusion in the region of the dividing wall duct.

8. The heat exchanger according to claim 7, wherein the protrusion extends in a direction away from the dividing wall duct such that the dividing wall duct is open at the at least one of the upper part and the lower part of the housing.

9. The heat exchanger according to claim 6, wherein the dividing wall duct is arranged in the region of the outlet.

10. The heat exchanger according to claim 6, wherein one distal end of the dividing wall duct is at a distance h from a lower edge of the turbulence-generating insert, and another distal end of the dividing wall duct is at a distance h1 from an upper edge of the turbulence-generating insert.

11. The heat exchanger according to claim 1, wherein the dividing wall duct is arranged in the region of the outlet.

12. The heat exchanger according to claim 1, wherein:

one distal end of the dividing wall duct is at a distance h from a lower edge of the turbulence-generating insert and another distal end of the dividing wall duct is at a distance h1 from an upper edge of the turbulence-generating insert; or one distal end of the dividing wall duct is at a distance h from the lower edge of the turbulence-generating insert, another distal end of the dividing wall duct is aligned with the upper edge of the turbulence-generating insert, and a side wall of the dividing wall duct facing the inlet of the housing is notched in the region of the longitudinal end of the dividing wall duct facing an upper part of the housing.

13. The heat exchanger according to claim 1, wherein the dividing wall duct is at a distance B of 10 $mm \leq B \leq 60$ mm from the input-side tube plate.

14. The heat exchanger according to claim 1, wherein the at least one turbulence-generating insert has a height H of 50 $mm \leq H \leq 96$ mm, and the dividing wall duct is shorter by a height h of 3 $mm \leq h \leq 20$ mm than the height H of the turbulence-generating insert.

15. The heat exchanger according to claim 14, further comprising a ratio H/h of $2.5 \leq H/h \leq 32$.

16. The heat exchanger according to claim 1, wherein at least one of:

the heat exchanger is a charge-air cooler, and the at least one turbulence-generating insert is a sheet-metal punched part.

17. A heat exchanger for a first medium and a second medium, comprising:

a turbulence-generating insert including a plurality of ducts having permeable side walls for the second medium; and at least one dividing wall duct having closed side walls and being open at both longitudinal ends such that the flow can pass therethrough, the at least one dividing wall duct running transverse to the plurality of ducts of the turbulence-generating insert;

wherein one of:

the dividing wall duct is shorter than the turbulence-generating insert, and distal ends of the dividing wall duct are spaced a distance from respective opposite edges of the turbulence-generating insert; or the dividing wall duct is shorter than the turbulence-generating insert with one distal end of the dividing wall duct aligned with one edge of the turbulence-generating insert, the dividing wall duct having a notched side wall;

wherein the at least one dividing wall duct is produced by a compression process resulting in the at least one dividing wall duct having a rising first flank and a second flank, the rising first flank forming an obtuse angle with a portion of the bottom of the at least one turbulence-generating insert to which an end of the rising first flank is connected, the second flank forming an acute angle with another portion of the bottom of the at least one turbulence-generating insert to which an end of the second flank is connected, the rising first flank and the second flank connected to each other in a region of the top of the at least one turbulence-generating insert such that the rising first flank substantially overlaps the second flank; and wherein the ends of the rising first flank and the second flank connected to the respective portions of the bottom of the at least one turbulence-generating insert are spaced apart from one another at a distance smaller than a maximum opening distance of the dividing wall duct formed between the rising first flank and the second flank.

18. The heat exchanger according to claim 17, wherein the turbulence-generating insert has a height H of 50 mm≤H≤96 mm, and the dividing wall duct is shorter by a height h of 3 mm≤h≤20 mm than the height H of the turbulence-generating insert.

19. The heat exchanger according to claim 18, further comprising a ratio H/h of 2.5≤H/h≤32.

* * * * *